US007269936B2

(12) United States Patent
Yamamoto et al.

(10) Patent No.: US 7,269,936 B2
(45) Date of Patent: Sep. 18, 2007

(54) SPINNING DEVICE AND METHOD FOR DETECTING FIBER ACCUMULATED STATE

(75) Inventors: Atsushi Yamamoto, Uji (JP); Tomoaki Takahashi, Kyoto (JP); Masaki Oka, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 11/245,088

(22) Filed: Oct. 7, 2005

(65) Prior Publication Data

US 2006/0096271 A1 May 11, 2006

(30) Foreign Application Priority Data

Nov. 5, 2004 (JP) ..... 2004-322320

(51) Int. Cl.
*D01H 4/02* (2006.01)

(52) U.S. Cl. ..... 57/350

(58) Field of Classification Search ..... 57/289, 57/315, 333, 350, 403
See application file for complete search history.

(56) References Cited

U.S. PATENT DOCUMENTS

| | | | | |
|---|---|---|---|---|
| 6,134,872 | A * | 10/2000 | Olbrich | 57/264 |
| 6,370,858 | B1 * | 4/2002 | Mori | 57/6 |
| 2003/0121247 | A1 * | 7/2003 | Stalder et al. | 57/333 |

FOREIGN PATENT DOCUMENTS

| | | | |
|---|---|---|---|
| DE | 19511960 | A1 | 10/1996 |
| JP | 10-46438 | | 2/1998 |
| JP | 2001-192938 | | 7/2001 |
| JP | 2001192938 | A | 7/2001 |
| JP | 2003278034 | A | 10/2003 |

OTHER PUBLICATIONS

European Search Report dated Apr. 20, 2007, issued in corresponding European Patent Application No. 05 02 0965.

* cited by examiner

*Primary Examiner*—Shaun R. Hurley
(74) *Attorney, Agent, or Firm*—Westerman, Hattori, Daniels & Adrian, LLP.

(57) ABSTRACT

It is an object of the present invention to provide a spinning device that detects early that fibers F have been accumulated in an air exhausting space 55 to prevent a defect (weak yarn) in a spun yarn. A spinning device in accordance with the present invention includes a pneumatic spinning nozzle 19, a whirling current generating chamber 25 in which fibers are twisted using a whirling air current generated by the pneumatic spinning nozzle, an air exhausting space 55 that is in communication with the whirling current generating chamber 25, a negative pressure source that sucks air from the air exhausting space 55, and a pressure sensor 63 that detects a pressure in the air exhausting space 55. When the pressure detected by the pressure sensor 63 during a spinning operation performed by the pneumatic spinning nozzle 19 rises to at least a predetermined value, the unit controller 32 performs control such that the spinning operation is stopped. The unit controller 32 further lights an alarm lamp 71.

12 Claims, 5 Drawing Sheets

SPINNING DEVICE AND METHOD FOR DETECTING FIBER ACCUMULATED STATE

FIELD OF THE INVENTION

The present invention relates to the configuration of a spinning device, and in particular, to a configuration that can easily sense a state in which a spun yarn is likely to become defective.

BACKGROUND OF THE INVENTION

The Unexamined Japanese Patent Application Publication (Tokkai-Hei) No. 2001-192938 discloses a spinning device that spins a yarn by opening a bundle of fibers using a whirling air current generated by a pneumatic spinning nozzle and twisting the fibers while winding them around the periphery of a tip portion of a hollow guide shaft. In this configuration, an air exhausting space is in communication with a hollow chamber in the tip portion of the hollow guide shaft. A whirling air current generated by the pneumatic spinning nozzle flows from the hollow chamber to the air exhausting space, where it is exhausted.

Then, the Unexamined Japanese Patent Application Publication (Tokkai-Hei) No. 2001-192938 points out the following problem. When the fibers are looped around the periphery of the hollow guide shaft in the air exhausting space, fibers subsequently discharged from the hollow chamber may be twined around the loop. In this case, the subsequent fibers may not be discharged to the exterior. This prevents air from flowing normally out of the hollow chamber, thus hindering the normal whirling current in the hollow chamber. This causes a defect in the yarn (what is called a weak yarn). The Unexamined Japanese Patent Application Publication (Tokkai-Hei) No. 2001-192938 further states that such a problem can be solved by increasing the outer peripheral length of lager diameter portion of the hollow guide shaft which is located in the air exhausting space, above the mean fiber length of the bundle of fibers.

However, even with the above increase in the outer peripheral length of the larger diameter portion, the fibers may be looped around the larger diameter portion. Accordingly, the above configuration is not always sufficiently effective in preventing the weak yarn.

In response to a recently growing demand for multi-type small-amount production, the same spinning device may be used to spin fibers of various fiber lengths. The shape of the hollow guide shaft may be set so as to increase the outer peripheral length above the possible maximum fiber length. However, this may increase the size of the spinning device.

A description has been given of the problems to be solved by the present invention. Now, a description will be given of means for solving the problems and their effects.

SUMMARY OF THE INVENTION

A first aspect of the present invention provides a spinning device configured as described below.

The spinning device comprises a pneumatic spinning nozzle, a hollow chamber in which fibers are twisted using a whirling air current generated by the pneumatic spinning nozzle, an air exhausting space that is in communication with the hollow chamber, sucking means for sucking air from the air exhausting space, and pressure detecting means for detecting a pressure in the air exhausting space.

This makes it possible to reliably sense a state in which fibers are likely to be accumulated in the air exhausting space to cause a defective, weak yarn. The above spinning device is preferably configured as described below.

The spinning device comprises control means for controlling a spinning operation during a spinning operation performed by the pneumatic spinning nozzle, on the basis of a result of detection carried out by the pressure detecting means. This enables the spinning operation to be stopped to prevent a package from being degraded as a result of a weak yarn. Further, the spinning device can perform control such that the spinning operation can be reliably stopped before, for example, a defective, weak yarn occurs frequently. This makes it possible to improve the operating efficiency of the spinning device.

Preferably, the above spinning device is further configured as described below.

The sucking means is configured to suck air from one side of the air exhausting space. The pressure detecting means is configured to detect a pressure in a part of the air exhausting space which lies opposite the side from which the sucking means sucks air, across a yarn path.

Thus, the pressure detecting means detects the pressure in the air exhausting space at a position further from the suction side than the yarn path. This makes it possible to detect accumulation of fibers in the air exhausting space as a change in pressure detected by the pressure detecting means. It is therefore possible to accurately detect that fibers have been accumulated in the air exhausting space.

The spinning device preferably comprises alarm means for alarming an operator that the pressure detected by the pressure detecting means exceeds a threshold.

This enables an operator to be promptly alarmed that fibers have been accumulated in the air exhausting space. It is thus possible to urge the operator to remove the fibers from the air exhausting space so as to recover early the state in which a spinning operation can be performed.

The spinning device is preferably configured as described below.

The pressure detecting means is connected to a pressure detecting hole opened in a wall surface of the air exhausting space. Air can be injected into the air exhausting space through the pressure detecting hole.

Thus, even if the pressure detecting hole is blocked with fibers, air can be injected through the pressure detecting hole to reliably remove the fibers. This makes it possible to prevent erroneous detections performed by the pressure detecting means.

A second aspect of the present invention provides a method for detecting a fiber accumulated state in a spinning device. In a spinning device comprising a pneumatic spinning nozzle, a hollow chamber in which fibers are twisted using a whirling air current generated by the pneumatic spinning nozzle, an air exhausting space that is in communication with the hollow chamber, and sucking means for sucking air from the air exhausting space, pressure detecting means for detecting a pressure in the air exhausting space is provided. When the pressure detected by the pressure detecting means exceeds a threshold, the device determines that fibers have been accumulated in the air exhausting space.

This makes it possible to easily and reliably determine whether or not fibers have been accumulated in the air exhausting space (this may cause a defective, weak yarn).

DETAILED DESCRIPTION OF THE PREFERRED EMBODIMENT

A preferred embodiment of the present invention will be described below with reference to the accompanying drawings.

Figure 1:
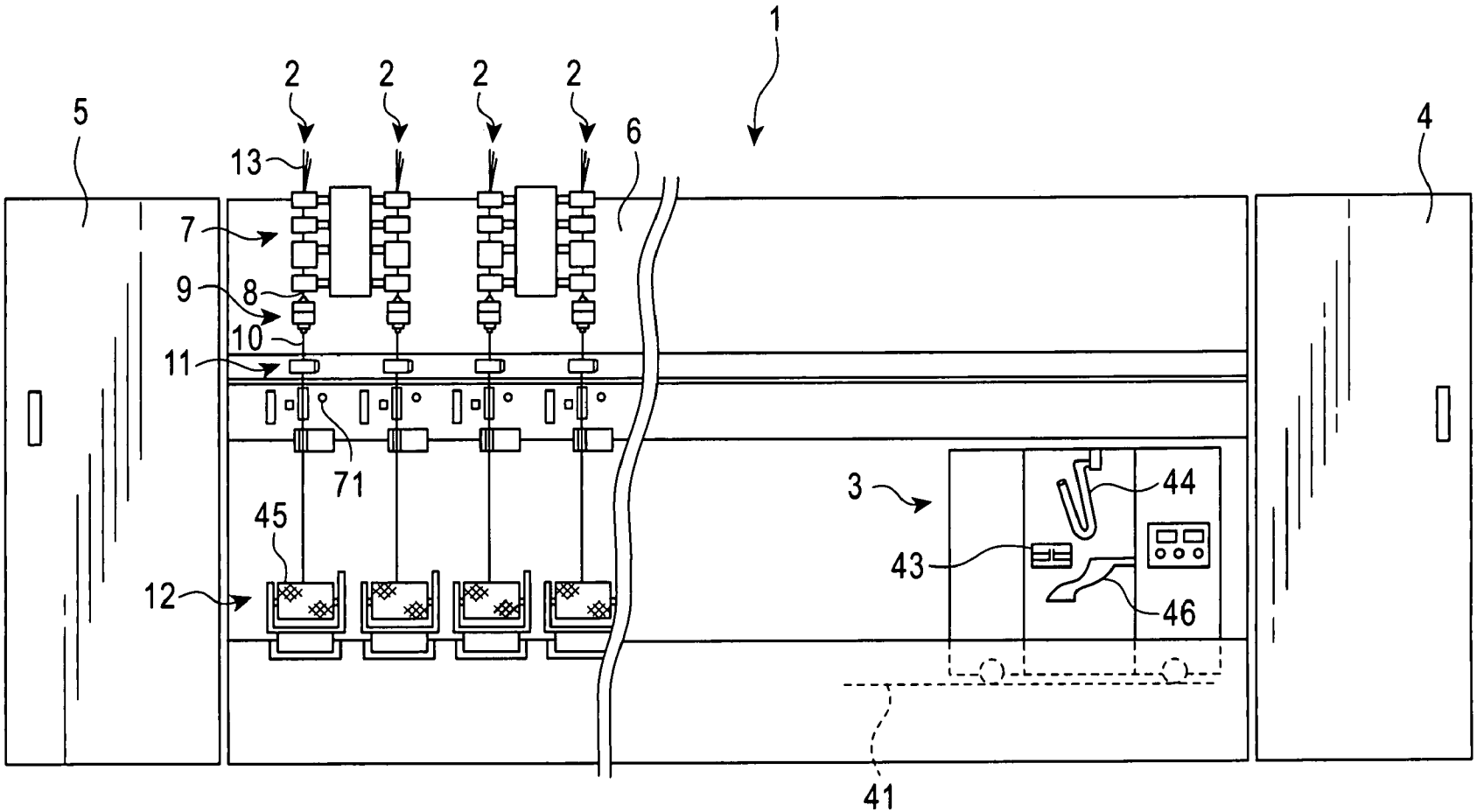
FIG. 1 is a front view of a spinning device according to an embodiment of the present invention.

FIG. 1 shows a spinning device 1 according to an embodiment of the present invention. The spinning device 1 comprises a large number of spinning units 2 arranged in a line. The spinning device 1 is provided with a yarn splicing carriage 3, a blower box 4, and a motor box 5. The yarn splicing carriage 3 can run in the direction in which the spinning units 2 are arranged.

As shown in FIG. 1, each spinning unit 2 is mainly composed of a draft device 7, a spinning section 9, a yarn feeding device 11, and a winding device 12. The draft device 7 is provided near an upper end of a casing 6 of the spinning device 1 main body. The spinning section 9 spins a bundle of fibers 8 fed by the draft device 7. The yarn feeding device 11 feeds a spun yarn 10 discharged by the spinning section 9. The winding device 12 then winds the spun yarn 10 to form a package 45.

Figure 2:
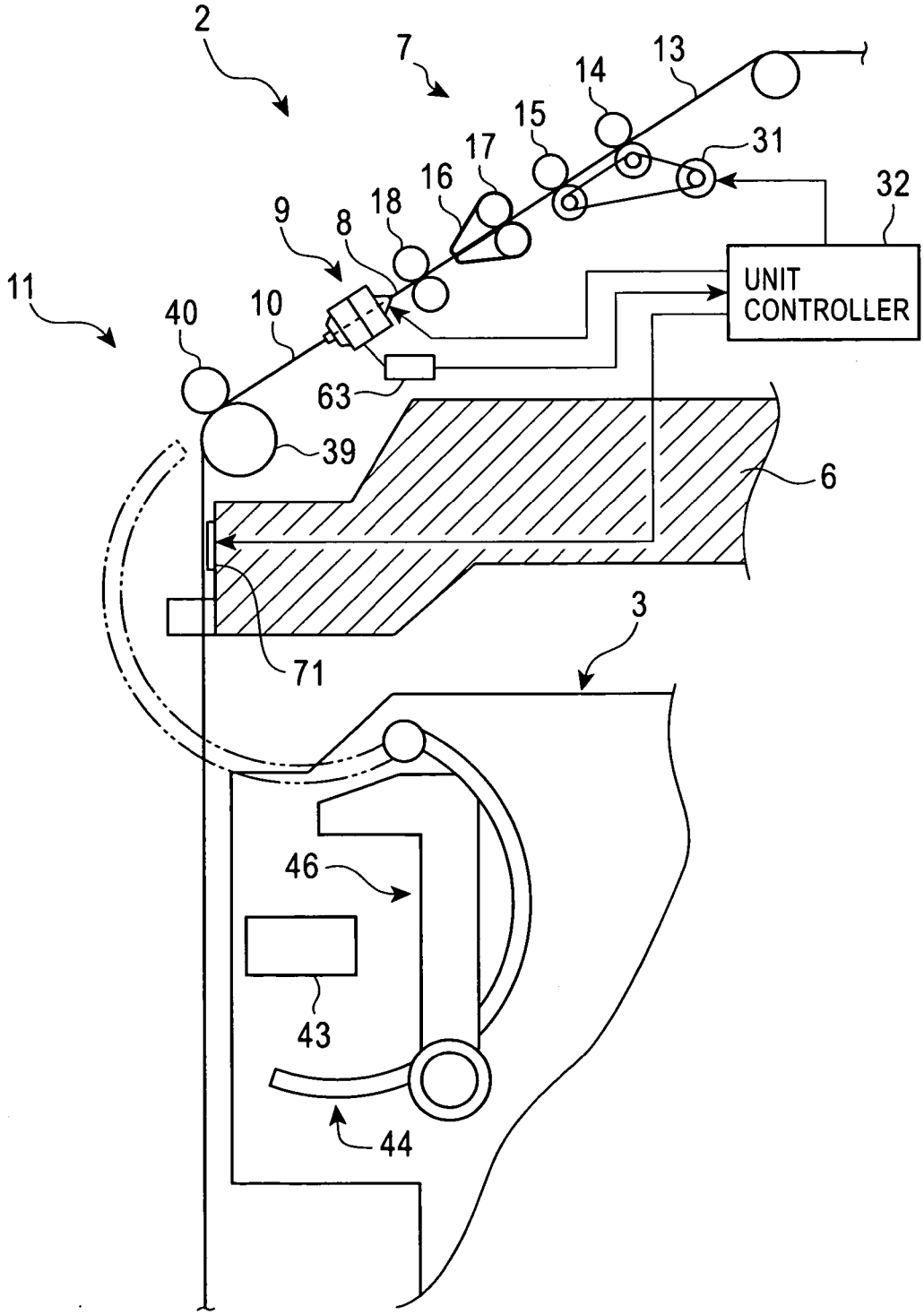
FIG. 2 is a vertical sectional view of the spinning device according to the embodiment of the present invention.

As shown in FIG. 2, the draft device 7 drafts a sliver 13 into the bundle of fibers 8 and is composed of a back roller 14, a third roller 15, a middle roller 17 over which an apron belt 16 is looped, and a front roller 18.

A draft motor 31 comprising an electric motor is installed at an appropriate position in the casing 6. The back roller 14 and the third roller 15 are connected to the draft motor 31 via a belt. A unit controller (control means) 32 provided in each spinning unit 2 controls driving and stoppage of the draft motor 31. In the spinning device 1 in accordance with the present embodiment, the casing 6 is provided with a motor used to drive the middle roller 17 and front roller 18. However, illustration of this motor is omitted.

The yarn feeding device 11 comprises a delivery roller 39 supported on the casing 6 of the spinning device 1 main body, and a nip roller 40 provided in contact with the delivery roller 39. In this configuration, the spun yarn 10 discharged by the spinning section 9 is sandwiched between the delivery roller 39 and the nip roller 40. The delivery roller 39 is rotatively driven using an electric motor (not shown in the drawings) to feed the spun yarn 10 to the winding device 12.

An alarm lamp (alarm means) 71 is installed on a front surface of the casing 6 to alarm the operator that an abnormality is occurring in the spinning section 9. The alarm lamp 71 is connected to the unit controller 32.

As shown in FIGS. 1 and 2, the yarn splicing carriage 3 is adapted to run on a rail 41 provided in the casing 6 of the spinning device 1 main body. The yarn splicing carriage 3 comprises a yarn splicing device (for example, a splicer) 43, a suction pipe 44 and a suction mouth 46. The suction pipe 44 and the suction mouth 46 are provided on the splicing carriage 3 and respectively pivot around a shaft in a manner that the suction pipe 44 and the suction mouth 46 are freely laid down and set up. The suction pipe 44 sucks and catches a yarn end discharged by the spinning section 9 and then guides the yarn end to the yarn splicing device 43, while pivoting around the shaft. The suction mouth 46 sucks and catches a yarn end from the package 45 rotatably supported on the winding device 12 and then guides the yarn end to the yarn splicing device 43, while pivoting around the shft.

Figure 3:
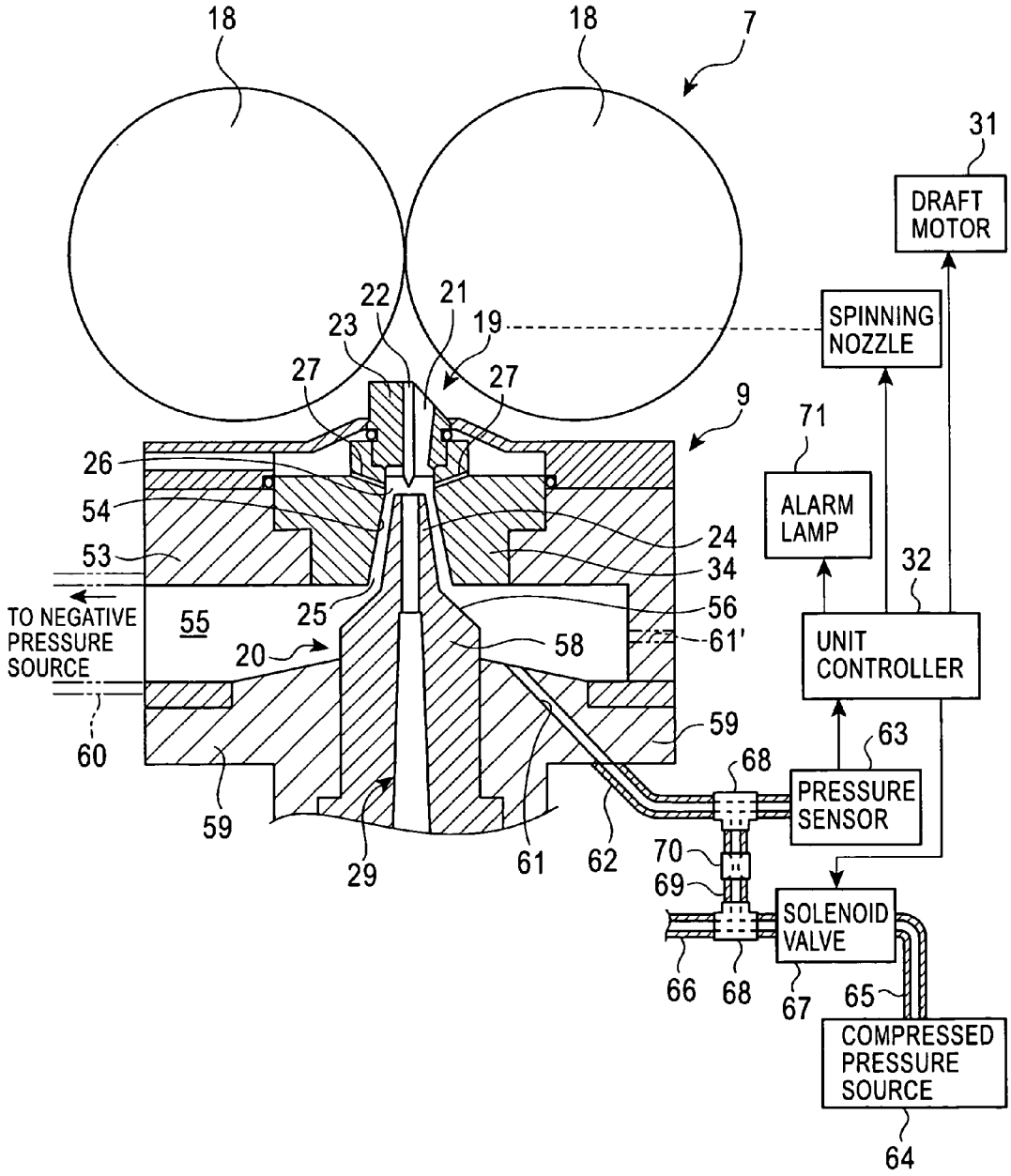
FIG. 3 is a vertical sectional view of a spinning section.

As shown in FIG. 3, the spinning section 9 in accordance with the present embodiment is mainly composed of a pneumatic spinning nozzle 19 through which the bundle of fibers 8 fed by the front roller 18 are passed while applying a whirling air current to the bundle of fibers 8, and a hollow guide shaft 20 having a tip potion coaxially inserted into the pneumatic spinning nozzle 19.

The pneumatic spinning nozzle 19 has a needle holder 23, a nozzle block 34, and a nozzle section casing 53 supporting the nozzle block 34. The needle holder 23 has a guide hole 21 and a needle 22. The bundle of fibers 8 drafted by the draft device 7, located upstream, is introduced through the guide hole 21. The needle 22 is held in a channel for the bundle of fibers 8 discharged from the guide hole 21.

A tapered hole 54 is formed in the nozzle block 34 downstream of the needle holder 23. A tip portion 24 of the hollow guide shaft 20 is coaxially inserted into the tapered hole 54 so that there is a predetermined spacing between the tip portion 24 and the tapered hole 54, and the tip portion 24 has almost the same taper angle as that of the tapered hole 54. A spinning chamber 26 is formed between a tip surface of the hollow guide shaft 26 and the needle holder 23. The tip of the needle 22 projects into the spinning chamber 26 and faces opposite the tip surface of the hollow guide shaft 20.

A whirling current generating chamber (hollow chamber) 25 is formed between the tapered hole 54 and the tip portion 24. An air exhausting space 55 is formed in the nozzle section casing 53. A negative pressure source (sucking means; not shown in the drawings) is connected to one side of the air exhausting space 55 through piping 60.

A plurality of whirling current generating nozzles 27 are formed in the nozzle block 34 so that their exit ends are opened into the spinning chamber 26. Each of the whirling current generating nozzle 27 is composed of a hole drilled in the nozzle block 34 so as to incline in a tangential and downstream direction of the spinning chamber 26. The whirling current generating nozzles 27 receive compressed air supplied by a compressed air source (not shown in the drawings). The whirling current generating nozzles 27 then inject the compressed air into the spinning chamber 26 to generate a whirling current, for example, flowing counter-clockwise in a plan view (see FIG. 4). The whirling current flows spirally downstream along the whirling current generating chamber 25 around the tip portion 24 of the hollow guide shaft 20. The whirling current is then exhausted from the air exhausting space 55, formed in the nozzle section casing 53.

The hollow guide shaft 20 is composed of a cylinder 56 having the tip portion 24. A yarn passage 29 is formed along the axis of the hollow guide shaft 20, and a yarn passes through the yarn passage 29 and then the spun yarn 10 is discharged via a downstream exit hole (not shown in the drawings).

A larger diameter portion 58 having an increased diameter is formed downstream of the tip portion 24 of the cylinder 56. The larger diameter portion 58 is exposed to the air exhausting space 55. The larger diameter portion 58 is fixedly inserted into a shaft holding member 59.

Here, the shaft holding member 59 can be moved close to and away from the nozzle section casing 53. With this operation, when the negative pressure source fails to suck and remove the fibers due to the fibers blocking the spinning chamber 26 or the whirling current generating chamber 25 or the fibers accumulating in the air exhausting space 55, the shaft holding member 59 is moved away from the nozzle section casing 53 to open the air exhausting space 55, whirling current generating chamber 25, and spinning chamber 26. This enables the fibers to be easily removed.

A pressure detecting hole 61 is formed in the shaft holding member 59 so as to obliquely penetrate the shaft holding member 59. The pressure detecting hole 61 is opened in a wall surface of the air exhausting space 55, specifically, a floor surface of the air exhausting space 55 which lies in the vicinity of a proximal end of the larger diameter portion 58 of the cylinder 56. The pressure detecting hole 61 is connected to a pressure sensor (pressure detecting means) 63 via a tube 62. The pressure sensor 63 comprises a data processing section (not shown in the drawings). Accordingly, if a detected pressure exceeds a threshold, the pressure sensor 63 transmits a fiber accumulation signal to the unit controller 32.

The spinning device 1 in accordance with the present embodiment comprises an appropriate compressed pressure source 64 connected to a cleaning line 66 via an air compressing tube 65. The cleaning line 66 injects compressed air against, for example, the periphery of the guide hole 21 in the pneumatic spinning nozzle 19. A solenoid valve 67 is installed in the air compressing tube 65. The solenoid valve 67 is controllably opened and closed in accordance with an actuation signal from the unit controller 32. The cleaning line 66 and the tube 62 are connected together through joints 68, 68 and a relay pipe 69. An orifice 70 is installed in the middle of the relay pipe 69.

Now, operations of the present embodiment will be described.

First, at the beginning of spinning, the unit controller 32 opens the solenoid valve 67 for a predetermined time to supply compressed air to the cleaning line 66 to clean the periphery of the guide hole 21 in the pneumatic spinning nozzle 19.

In this case, compressed air from the compressed air source 64 is supplied to the pressure detecting hole 61 through the relay pipe 69. The compressed air is then injected into the air exhausting space 55 through the pressure sensing hole 61. As a result, even if the pressure detecting hole 61 is blocked with fibers (as described below), the fibers can be blown away from the pressure detecting hole 61. The pressure sensor 63 can accurately measure the pressure in an opening part of the pressure detecting hole 61. The orifice 70 adjusts the amount of compressed air supplied so as to prevent the pressure in the pressure detecting hole 61 from rising sharply and departing from the permissible measurement range of the pressure sensor 63.

Then, the spinning section 9 starts spinning. During spinning, the bundle of fibers 8 or the spun yarn 10 continues from the front roller 18 through the guide hole 21, the spinning chamber 26, and the yarn passage 29 to the yarn feeding device 11. The yarn feeding device 11 exerts a downstream-acting feeding force to apply tension to the yarn.

Figure 4:
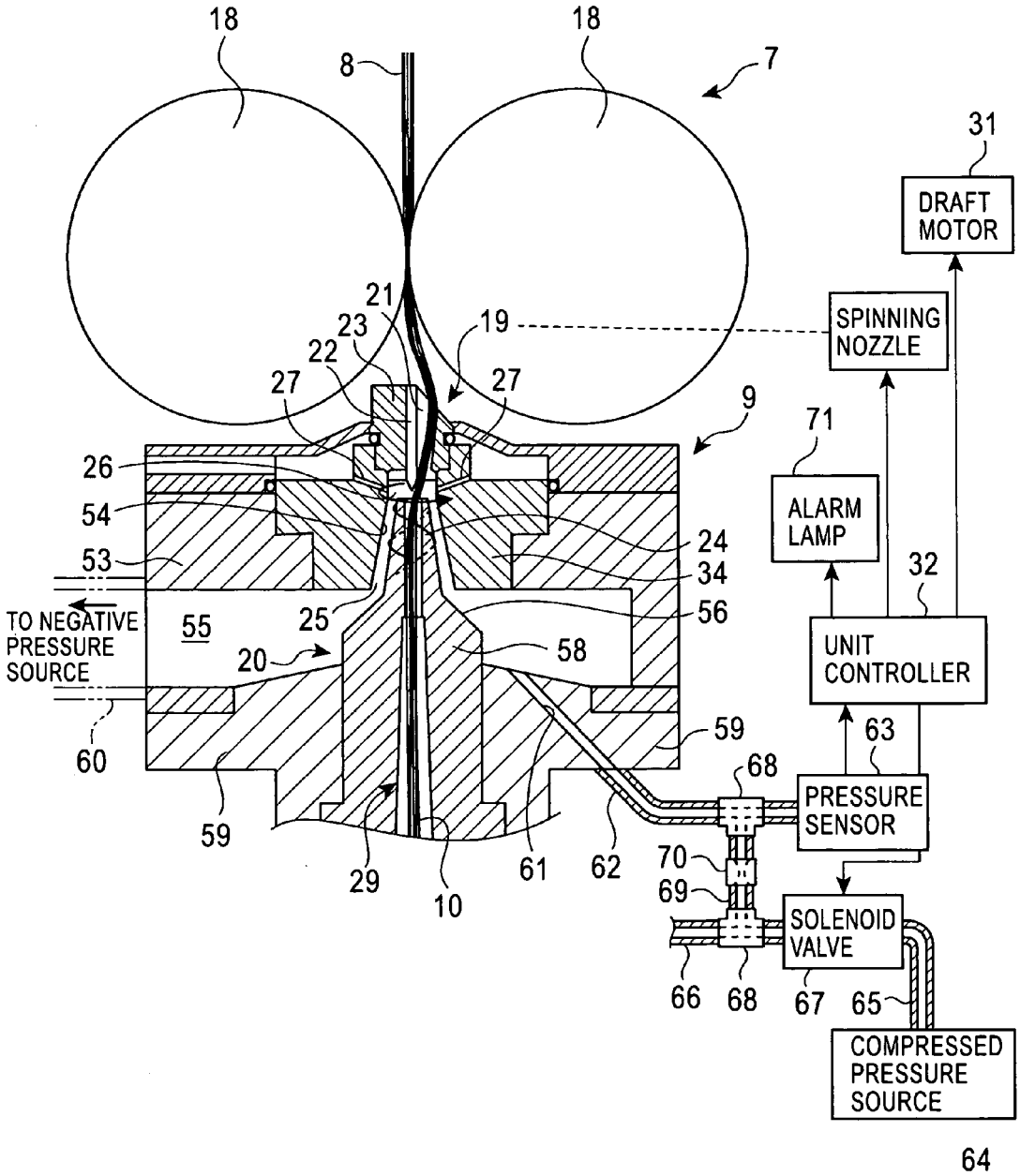
FIG. 4 is a diagram showing spinning being carried out.

As shown in FIG. 4, the bundle of fibers 8 discharged by the front roller 18 of the draft device 7 enters the spinning chamber 26 through the guide hole 21. In the spinning chamber 26, the bundle of fibers 8 is subjected to the action of a whirling current from the whirling current generating nozzle 27. Accordingly, among the bundle of fibers 8, one end potions of the short fibers separate from the remaining long fibers which constitute core fibers. The one end portions of the short fibers are thus opened and then swung around and twisted in the whirling current generating chamber 25. This twist tends to propagate toward the front roller 18. However, the propagation is inhibited by the needle 22, thus preventing the bundle of fibers 8 fed by the front roller 18 from being twisted. Thus, the needle 22 constitutes propagation preventing means. The thus twisted fibers are sequentially formed into a substantially twisted yarn which most of the fibers are wound around the core fibers. The yarn then passes through the yarn passage 29 and is discharged through the exit hole 34. The yarn then passes through the yarn feeding device 11 in FIG. 2 and is wound by the winging device 12 (FIG. 1).

Some fibers may be broken during the opening and twisting of the short fibers and fail to be twisted into the spun yarn 10. These fibers are fed from the whirling current generating chamber 25 to the air discharging space 55 by a whirling current induced by the whirling current generating nozzles 27. The negative pressure source then sucks and discharges the fibers via the piping 60.

Figure 5:
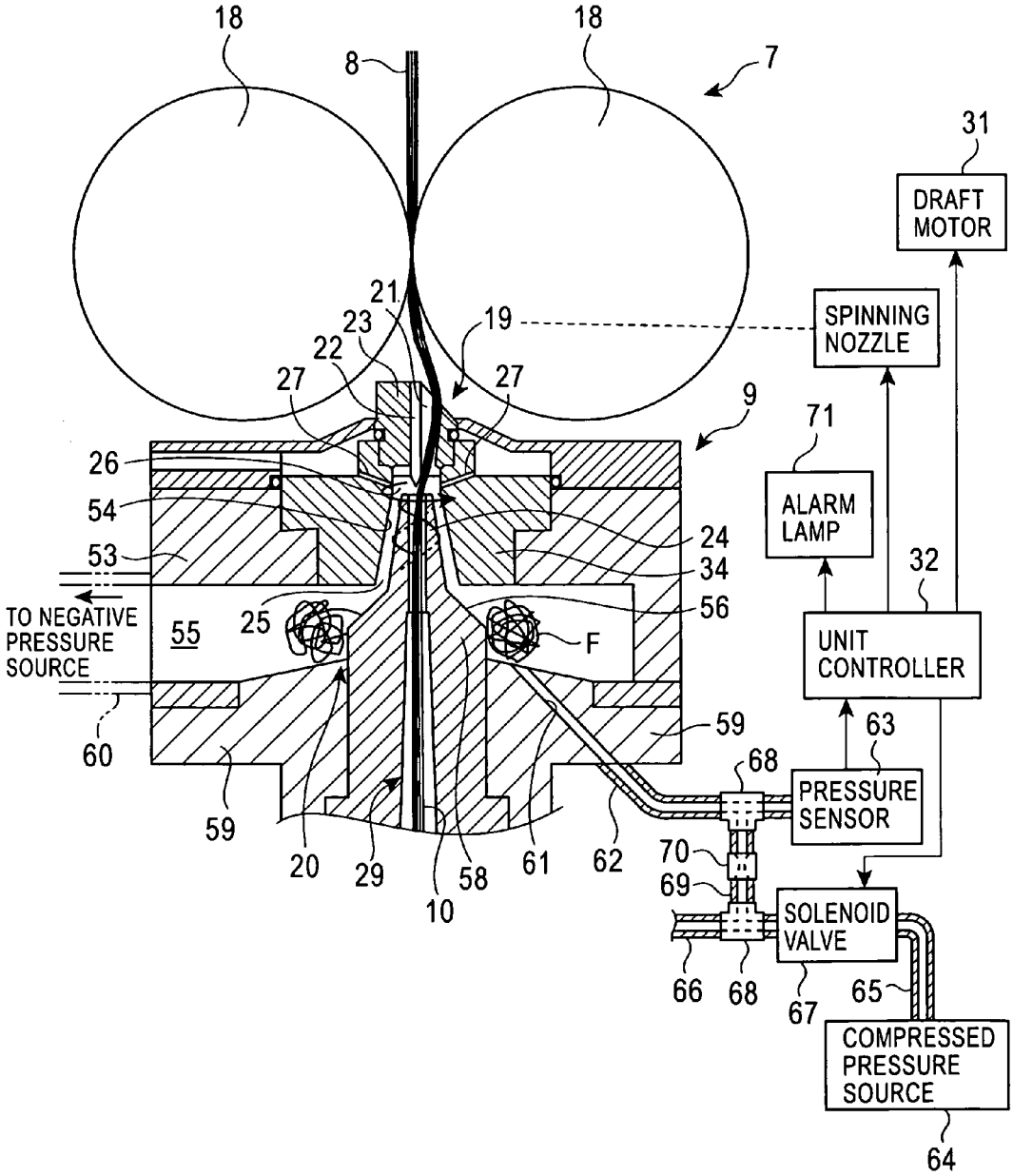
FIG. 5 is a diagram showing that fibers have been accumulated in an air exhausting space.

On the other hand, fibers to be discharged via the piping 60 as described above may be looped around the periphery of the larger diameter portion 58. The fibers may thus be accumulated in the air exhausting space 55 as shown in FIG. 5. A possible cause of this phenomenon will be described below. For example, fibers may be caught on a certain member inside the air exhausting space 55 and fail to be discharged even by a sucking flow from the negative pressure source. As spinning proceeds, the fibers may be intertwined with other fibers and the fibers grows gradually, and the length of the accumulated fibers may then become larger than outer peripheral length of the larger diameter portion 58. Finally, the fibers may grow into looped fibers F looping around the larger diameter portion 58. Another possible cause is as described below. In the present embodiment, the shaft holding member 59 is configured so that it can be separated from the nozzle section casing 53 for the convenience of maintenance operations. When the shaft holding member 59 is attached to a predetermined position so as to sit in proximity to the nozzle section casing 53 as shown in the figure, the fibers may be caught in the junction between the shaft holding member 59 and the nozzle section casing 53. The fibers may thus fail to be discharged and be twined with other fibers, and the fibers may then grow into the looped fibers F.

In this manner, the fibers F may grow to some degree to become dust in the air exhausting space 55 to hinder air from flowing out from the whirling current generating chamber 25 to the air exhausting space 55. This inhibits a normal whirling air current in the whirling current generating chamber 25, thus causing a weak yarn. Further, when are swung around in the whirling current generating chamber 25, short fibers opened during spinning may contact fibers accumulated around the periphery of the larger diameter portion 58. This inhibits the short fibers from being twisted into the yarn, also causing a weak yarn.

Thus, in the present embodiment, during spinning, the pressure sensor 63 is used to monitor the pressure in the opening part of the pressure detecting hole 61. The pressure in the opening part of the pressure detecting hole 61 is normally maintained at an appropriate negative pressure by a sucking flow from the negative pressure source. However, as the fibers are accumulated around the periphery of the hollow guide shaft 20, the accumulated fibers F hinder the sucking flow to gradually raise the pressure in the opening part of the pressure detecting hole 61. The pressure thus approaches atmospheric pressure. The pressure sensor 63 monitors the pressure in this part. When the detected value exceeds a threshold preset in the pressure sensor 63, the pressure sensor 63 sends a fiber accumulation signal to the unit controller 32.

Upon receiving the fiber accumulation signal during a spinning operation, the unit controller 32 immediately stops the draft motor 31 and to supply the bundle of fibers 8 to the spinning section 9. The unit controller 32 further stops the supply of compressed air to the pneumatic spinning nozzle 19 to stop the spinning operation. Then, the unit controller 32 lights the alarm lamp 71 to alarm the operator that fibers have been accumulated in the air exhausting space 55.

As described above, the spinning device 1 (spinning unit 2) in accordance with the present embodiment comprises the pressure sensor 63 that detects the pressure in the air exhausting space 55 in which air is sucked by the negative pressure source. When the pressure detected by the pressure sensor 63 during a spinning operation performed by the pneumatic spinning nozzle 19 rises to at least the predetermined value, the unit controller 32 stops the spinning operation.

This makes it possible to reliably detect the state in which fibers F are likely to be accumulated in the air exhausting space 55 to cause defective, weak yarn. The spinning operation can thus be automatically stopped. It is thus possible to prevent packages from being degraded as a result of weak yarns. Further, the spinning operation can be surely stopped before a defective, weak yarn occurs frequently. This enables the operating efficiency of the spinning device 1 to be improved.

In the spinning unit 2 in accordance with the present embodiment, the negative pressure source is configured to suck air from one side of the air exhausting space 55. The pressure sensor 63 is configured to detect the pressure in the part of the air exhausting space 55 which is opposite the side from which the negative pressure source sucks air, across the yarn path (hollow guide shaft 20) for the spun yarn 10.

Thus, the area in which the pressure sensor 63 detects the pressure is located far away from the suction side in the air exhausting space 55. Accordingly, when the fibers F are accumulated in the air exhausting space 55, the pressure sensor 63 can reliably detect this as a rise in detected pressure. This makes it possible to avoid erroneous detections performed by the pressure sensor 63.

Moreover, the spinning unit 2 in accordance with the present embodiment comprises the alarm lamp 71. During a spinning operation, when the pressure detected by the pressure sensor 63 rises, the unit controller 32 stops the spinning and lights the alarm lamp 71.

This enables the operator to be promptly alarmed that the fibers F have been accumulated in the air exhausting space 55. It is thus possible to urge the operator to remove the fibers F from the air exhausting space 55 so as to allow the spinning unit 2 to perform a spinning operation again.

Further, in the spinning unit 2 in accordance with the present embodiment, the pressure sensor 63 is connected to the pressure detecting hole 61, opened in the wall surface of the air exhausting space 55. Air can be injected into the air exhausting space 55 through the pressure detecting hole 61.

Thus, even if the pressure detecting hole 61 is blocked with the fibers F, the fibers F can be surely removed (from the pressure detecting hole 61) by injecting air into the air exhausting space 55 through the pressure detecting hole 61. It is therefore possible to prevent erroneous detections performed by the pressure sensor 63.

Furthermore, in the spinning unit 2 in accordance with the present embodiment, when the pressure detected by the pressure sensor 63 during a spinning operation exceeds the predetermined threshold, the unit controller 32 determines that the fibers F have been accumulated in the air exhausting space 55. The unit controller 32 thus performs control such that the spinning is stopped.

The above determining method makes it possible to easily and reliably determine whether or not the fibers F have been accumulated in the air exhausting space 55.

The embodiment of the present invention has been described but may further be changed as described below.

(1) The position of the pressure detecting hole 61 is arbitrary provided that the pressure detecting hole 61 is opened in the wall surface of the air exhausting space 55. For example, as shown by a chain line (reference numeral 61') in FIG. 3, the pressure detecting hole may be opened in the inner wall surface (instead of the floor surface) of the air exhausting space 55.

(2) In the present embodiment, the pressure sensor 63 comprises the data processing section. When the detected pressure exceeds the predetermined threshold (set for the pressure sensor 63), the pressure sensor 63 sends a fiber accumulation signal to the unit controller 32. However, the unit controller 32 may be provided with a function corresponding to the data processing section of the pressure sensor 63.

(3) Further, the condition that allows the device to determine that fibers have been accumulated in the air exhausting space 55 (in other words, the pressure in the air exhausting space has risen) may be the fact that the value detected by the pressure sensor 63 exceeds the threshold even at a moment or the fact that the time for which the threshold remains exceeded becomes longer than a predetermined one. Various methods are possible.

(4) The alarm lamp 71 may be disposed at an arbitrary position. Extinction and lighting control of the alarm lamp 71 may be performed in an arbitrary manner. For example, control may be performed such that the alarm lamp 71 is lighted under a normal state and is extinguished when the device determines that fibers have been accumulated in the air exhausting space 55. Further, instead of the alarm lamp 71, various members such as a buzzer may be used as alarm means. In short, any alarm means may be used provided that it can alarm the fiber accumulated state to the operator by apealing to the operator's five senses including vision and hearing.

(5) The pressure sensor 63 and the pressure detecting hole 61 are applicable not only to the spinning section 9 using the hollow guide shaft 20 but also to spinning sections with other configurations.

The invention claimed is:

1. A spinning device comprising a pneumatic spinning nozzle, a hollow chamber in which fibers are twisted using a whirling air current generated by the pneumatic spinning nozzle, an air exhausting space that is in communication with the hollow chamber, sucking means for sucking air from the air exhausting space, and pressure detecting means for detecting a pressure in the air exhausting space.

2. The spinning device according to claim 1, further comprising control means for controlling a spinning operation during a spinning operation performed by the pneumatic spinning nozzle, on the basis of a result of detection carried out by the pressure detecting means.

3. The spinning device according to claim 1, wherein the sucking means is configured to suck air from one side of the air exhausting space, and the pressure detecting means is configured to detect a pressure in a part of the air exhausting space which lies opposite the side from which the sucking means sucks air, across a yam path.

4. The spinning device according to claim 2, wherein the sucking means is configured to suck air from one side of the air exhausting space, and the pressure detecting means is configured to detect a pressure in a part of the air exhausting space which lies opposite the side from which the sucking means sucks air, across a yam path.

5. The spinning device according to claim 1, further comprising alarm means for alarming an operator that the pressure detected by the pressure detecting means exceeds a threshold.

6. The spinning device according to claim 2, further comprising alarm means for alarming an operator that the pressure detected by the pressure detecting means exceeds a threshold.

7. The spinning device according to claim 3, further comprising alarm means for alarming an operator that the pressure detected by the pressure detecting means exceeds a threshold.

8. The spinning device according to claim 1, wherein the pressure detecting means is connected to a pressure detecting hole opened in a wall surface of the air exhausting space, and a means for injecting air into the air exhausting space through the pressure detecting hole.

9. The spinning device according to claim 2, wherein the pressure detecting means is connected to a pressure detecting hole opened in a wall surface of the air exhausting space, and a means for injecting air into the air exhausting space through the pressure detecting hole.

10. The spinning device according to claim 3, wherein the pressure detecting means is connected to a pressure detecting hole opened in a wall surface of the air exhausting space, and a means for injecting air into the air exhausting space through the pressure detecting hole.

11. The spinning device according to claim 4, wherein the pressure detecting means is connected to a pressure detecting hole opened in a wall surface of the air exhausting space, and a means for injecting air into the air exhausting space through the pressure detecting hole.

12. A method for detecting a fiber accumulated state in a spinning device comprising a pneumatic spinning nozzle, a hollow chamber in which fibers are twisted using a whirling air current generated by the pneumatic spinning nozzle, an air exhausting space that is in communication with the hollow chamber, and sucking means for sucking air from the air exhausting space, the method includes:

providing pressure detecting means for detecting a pressure in the air exhausting space;

and determining that fibers have been accumulated in the air exhausting space when the pressure detected by the pressure detecting means exceeds a threshold.

* * * * *